US011793309B2

(12) United States Patent
Zhu

(10) Patent No.: US 11,793,309 B2
(45) Date of Patent: Oct. 24, 2023

(54) COLLAPSIBLE SUPPORT BASE FOR FURNITURE WITH A FLEXIBLE USER SUPPORT PLATFORM

(71) Applicant: MAXTON ENGINEERING LTD., Wan Chai (HK)

(72) Inventor: Shou Qiang Zhu, Wan Chai (HK)

(73) Assignee: MAXTON ENGINEERING LTD., Central (HK)

( * ) Notice: Subject to any disclaimer, the term of this patent is extended or adjusted under 35 U.S.C. 154(b) by 182 days.

(21) Appl. No.: 17/169,384

(22) Filed: Feb. 5, 2021

(65) Prior Publication Data

US 2021/0259423 A1 Aug. 26, 2021

Related U.S. Application Data

(60) Provisional application No. 62/970,332, filed on Feb. 5, 2020.

(51) Int. Cl.

| | |
|---|---|
| ***A47C 1/16*** | (2006.01) |
| ***A47C 4/28*** | (2006.01) |
| ***A47C 17/72*** | (2006.01) |

(52) U.S. Cl.

CPC ..... *A47C 4/286* (2013.01); *A47C 17/72* (2013.01)

(58) Field of Classification Search

CPC .. A47C 1/16; A47C 4/28; A47C 17/72; A47C 7/74; A47C 4/283; A47C 4/286; A47C 17/84; A47C 3/0255; A45F 3/24

See application file for complete search history.

(56) References Cited

U.S. PATENT DOCUMENTS

| | | | | |
|---|---|---|---|---|
| 1,231,686 | A * | 7/1917 | Zuniga | A47C 1/035 297/78 |
| 7,996,935 | B1 * | 8/2011 | Chen | A45F 3/24 5/120 |
| 10,631,648 | B1 * | 4/2020 | Tsai | A47C 4/286 |
| 10,660,443 | B1 * | 5/2020 | Tsai | A47C 4/286 |
| 10,758,048 | B1 * | 9/2020 | Tsai | A47C 3/00 |
| 11,096,493 | B1 * | 8/2021 | Tsai | A47C 4/286 |
| 11,330,906 | B1 * | 5/2022 | Tsai | A47C 4/26 |
| 2019/0290007 | A1 * | 9/2019 | Chen | A47C 4/286 |

* cited by examiner

*Primary Examiner* — Robert G Santos
*Assistant Examiner* — Ifeolu A Adeboyejo
(74) *Attorney, Agent, or Firm* — LIU & LIU

(57) ABSTRACT

A foldable support base for a foldable furniture with a flexible user support platform, in which a support frame has two side frame members, each pivotally connected to a load pivot joint along a load member with a load section extending beyond the load pivot joint which is pivotable about the first load pivot joint towards a center of the support frame. The load sections of the load members are configured for removably attaching a flexible user support platform therebetween. A load on the flexible user support platform results in a force component pulling on the load sections of the load members to cause the load members to pivot about the respective load pivot joints in a direction towards the flexible user support platform, thereby biasing to keep the side frame members to be spaced apart to maintain the support base in an extended configuration.

12 Claims, 15 Drawing Sheets

COLLAPSIBLE SUPPORT BASE FOR FURNITURE WITH A FLEXIBLE USER SUPPORT PLATFORM

This application claims the priority of U.S. Provisional Patent Application No. 62/970,332 filed on Feb. 5, 2020. This application is fully incorporated by reference as if fully set forth herein. All publications noted below are fully incorporated by reference as if fully set forth herein.

BACKGROUND OF THE INVENTION

1. Field of the Invention

The present invention is directed to collapsible/foldable furniture, and particularly to a foldable base for furniture, and more particular a foldable base having a collapsible support frame for portable furniture with a flexible user support platform, so the furniture can be easily stored and transported.

2. Background of the Invention

In recent years, more and more people love outdoor and recreational activities such as camping, field trips, or Bar-B-Q during their free time because many people may endure high pressure at work and have accumulated a lot of tension and stress. Not only can these outdoor activities help people release the stress, but also improve quality of life. Since most places for abovementioned outdoor activities do not have all the facilities, it may be more convenient for people to bring some outdoor furniture such as folding chairs, tables, etc. Thus, making the outdoor furniture light and easy to carry around become important issues for outdoor furniture manufacturers.

For many years, folding chairs are made by wood, however, these wooden folding chairs are usually heavy and lack long-term durability. Also, the wooden chairs are difficult to effectively stack together. Recently, folding chairs usually have metal chair frames that can be bent to desired shapes and coupled with seat pads, and they are generally light weight and portable. When not in use, these folding chairs can be folded, and the folded chairs are easily stacked for storage or transportation.

U.S. Pat. No. 6,305,742 to Spendlove et al. discloses a folding chair with a seat pivotably coupled to a foldable support frame. The foldable support frame is designed for folding chairs with a seat having a rigid seat frame pivotably coupled to the frame. Such foldable support frame is not suitable for supporting a seat that is made of a flexible, web or membrane type material (e.g., fabric, canvas, etc.), which does not include a rigid seat frame pivotably coupled to the support frame.

Heretofore, various folding chairs have been developed with a seat made of a flexible seating material, which facilitates collapsing the frame to further reduce the overall size of the chair for transport and storage. U.S. Pat. No. 7,758,111 to Chen discloses a folding chair having a collapsible supporting frame that includes backrest and armrests. The main purpose of the supporting backrest is to enforce the supporting force of the rear leg rods and prevent them from being deformed by the inwardly stress of the backrest unit, and the entire chair structure would be more stabilized. Even though the chair can be folded into a compact size, it may take some extra steps such as removing the backrest unit and removing the armrests from their original positions, which may be inconvenient and impractical for the user. To unfold chair for use, attachments of separate frame members are required to complete configuration of the support frame for stable seating.

Therefore, there remains a need for an improved foldable support base for furniture with a flexible user resting support platform, such as a folding chair with a flexible seat, which is comfortable and stable for the user to rest on, and which is supported by a foldable or collapsible support frame that is more convenient and efficient for the user to unfold or store with reduced burden on the users.

SUMMARY OF THE INVENTION

The present invention overcomes the drawbacks of the prior art. The present invention is directed to foldable and/or collapsible furniture and an improved foldable or collapsible support base for furniture (e.g., a chair) with a flexible user support platform (e.g., defining a user resting, sitting or sleeping surface) for users, which is comfortable and stable for the user to rest on the platform, and that is more convenient and efficient for the user to unfold or store with reduced burden on the users.

The inventive support base can be deployed in various furniture with a flexible user support platform, which may be padded or unpadded, constructed using a flexible material, such as a web material made of a synthetic and/or natural fabric or cloth, canvas, a woven, sheet, mesh or netting material, etc. Hereinbelow, the flexible material for the flexible support platform may be generally referred to hereinbelow as a "fabric" without limiting to a particular type of flexible material.) The present invention will be disclosed below in reference to chairs and hammocks as exemplary embodiments of foldable furniture with a flexible user support platform incorporating the novel foldable/collapsible support base.

In one aspect of the present invention, it is an object of the present invention to provide a foldable chair that is comfortable and stable for the user to sit and all elements of the folding chair can be easily collapsed and closely folded into a compact size. It is another object of the present invention to provide a foldable chair wherein the chair's structure can be more stable and strengthened when an external force applies. It is still a further object of the present invention to provide a folding chair that can be easily manufactured, stored and stacked.

The above objectives are also applicable to the other furniture items disclosed herein.

In one aspect, a foldable chair that includes a flexible seat and a chair frame. The chair frame may include rear supporting rods, first front supporting rods, second front supporting rods, and a supporting base. In one embodiment, each rear supporting rods may include a plurality of rear connecting rods that can be formed from connectable sections or telescopically connected to form each rear supporting rod.

In one embodiment, the rear supporting rods extend upwards from a rear portion of the supporting base, while the first front supporting rods extend from one side of a front portion of the supporting base, and the second front supporting rods extend from the other side of the front portion of the supporting base.

The supporting base has a plurality of base connecting rods forming substantially four sides of the supporting base. Each side may include two base connecting rods forming a single scissor hinge structure pivotally interconnecting with each other and other base connecting rods on two nearby sides.

It is important to note that the chair structure can be more stable and strengthened when the first front supporting rods move away from each other in an extended configuration, as well as the second front supporting rods. When the fabric is put on the chair frame, the end of the first front supporting rods are disposed in a first pocket of the fabric, while the end of the second front supporting rods are disposed in a second pocket. Due to the tension in the fabric seat (e.g., from elasticity of the fabric), the first front supporting rods can be further separated to extend from inward pulling by the first pocket, as well as the second front supporting rods by the second pocket, so the entire chair structure can be strengthened and becomes more stable.

When the chair is in use, for example, a user is sitting on the fabric, and under the weight of the fabric, the pockets of the fabric pulls the ends of the first front supporting rods and the second front supporting rods inwards, thus applying an external force to bias the first and second front supporting rods to extend against the other parts of the support base, so the chair structure can be more strengthened and stable. In other words, when the chair is in use, the user's weight helps the chair reach its most stable status.

When the chair is not in use, it is easy to fold because the supporting rods are pivotally (and some rods are telescopically connected) and they can be folded. Moreover, since the supporting base is formed by two base connecting rods on each side with a single scissor hinge structure pivotally interconnecting with each other and other base connecting rods, the size of the supporting base can also be easily minimized.

For any of the longer support rods in the chair structure, they may be telescopically formed or formed from connectable sections.

In another aspect, the present invention is directed to a foldable support base for a foldable furniture with a flexible user support platform, in which a support frame has two side frame members, each pivotally connected to a load pivot joint along a load member with a load section extending beyond the load pivot joint which is pivotable about the first load pivot joint towards a center of the support frame. The load sections of the load members are configured for removably attaching a flexible user support platform therebetween. A load on the flexible user support platform results in a force component pulling on the load sections of the load members to cause the load members to pivot about the respective load pivot joints in a direction towards the flexible user support platform, thereby biasing to keep the side frame members to be spaced apart to maintain the support base in an extended configuration.

BRIEF DESCRIPTION OF THE DRAWINGS

For a fuller understanding of the nature and advantages of the invention, as well as the preferred mode of use, reference should be made to the following detailed description read in conjunction with the accompanying drawings. In the following drawings, like reference numerals designate like or similar parts throughout the drawings.

FIGS. 7A to 7C are views corresponding to the views of FIGS. 6A to 6C for comparisons, wherein FIG. 7A illustrates a perspective view of a foldable swing chair incorporating the foldable support base in accordance with another embodiment of the present invention; FIG. 7B is a front perspective view of the foldable support base of the foldable swing chair without the fabric seat; FIG. 7C is a front view of the foldable support base for the swing chair in a partially collapsed configuration.

FIGS. 8A to 8C are views corresponding to the views of FIGS. 6A to 6C and FIGS. 7A to 7C for comparisons, wherein FIG. 8A illustrates a perspective view of a foldable hammock incorporating the foldable support base in accordance with another embodiment of the present invention; FIG. 8B is a front perspective view of the foldable support base of the foldable hammock without the hammock bed; FIG. 8C is a front view of the foldable support base for the foldable hammock in a partially collapsed configuration.

DETAILED DESCRIPTION OF THE INVENTION

Figure 1:
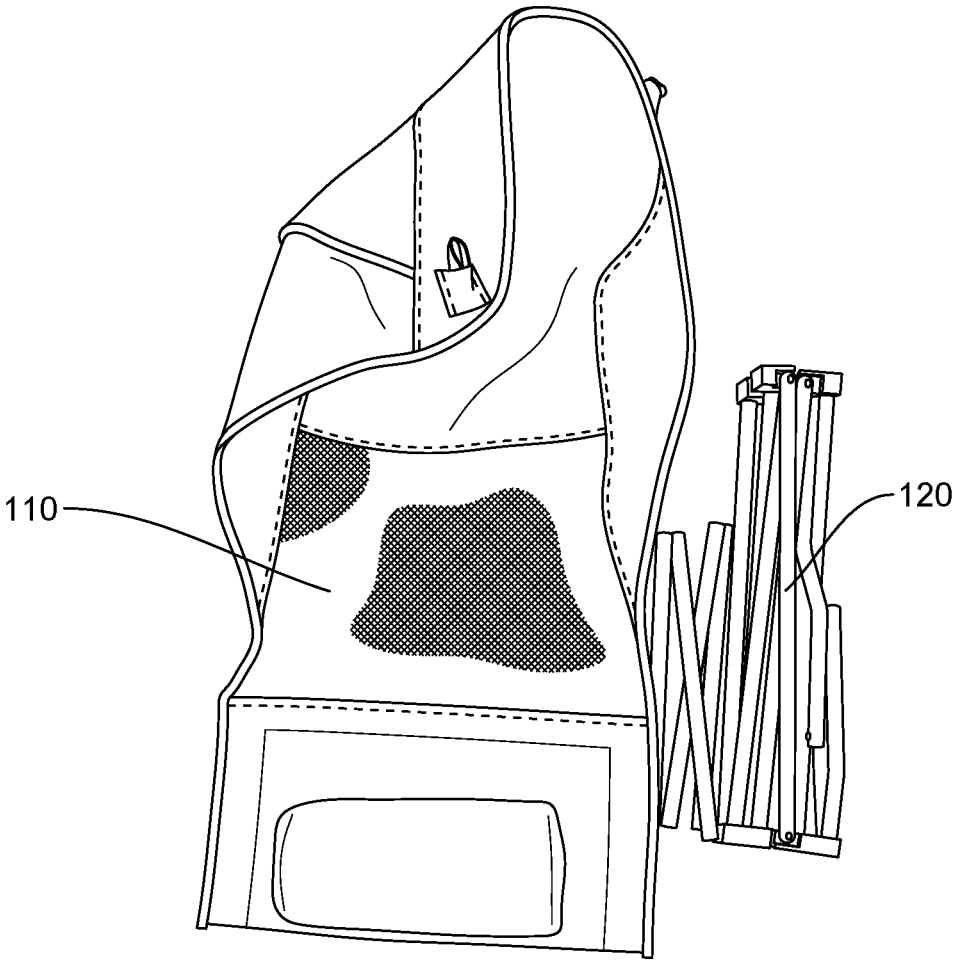
FIG. 1 illustrates a schematic view of the fabric and chair frame that have not been assembled as a chair in accordance with one embodiment of the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The inventive support base can be deployed in various furniture with a flexible user support platform, which may be padded or unpadded, constructed using a flexible material, such as a web material made of a synthetic and/or natural fabric or cloth, canvas, a woven, sheet, mesh or netting material, etc. Hereinbelow, the flexible material for the flexible support platform may be generally referred to hereinbelow as a "fabric" without limiting to a particular type of flexible material.) The present invention will be disclosed below in reference to chairs and hammocks as exemplary embodiments of foldable furniture with a flexible user support platform incorporating the novel foldable/collapsible support base.

Prior to a detail discussion of the structure of the inventive foldable support base, it is beneficial to discuss a specific deployment of the inventive foldable support base in reference of a foldable chair having a flexible user support platform.

Figure 2:
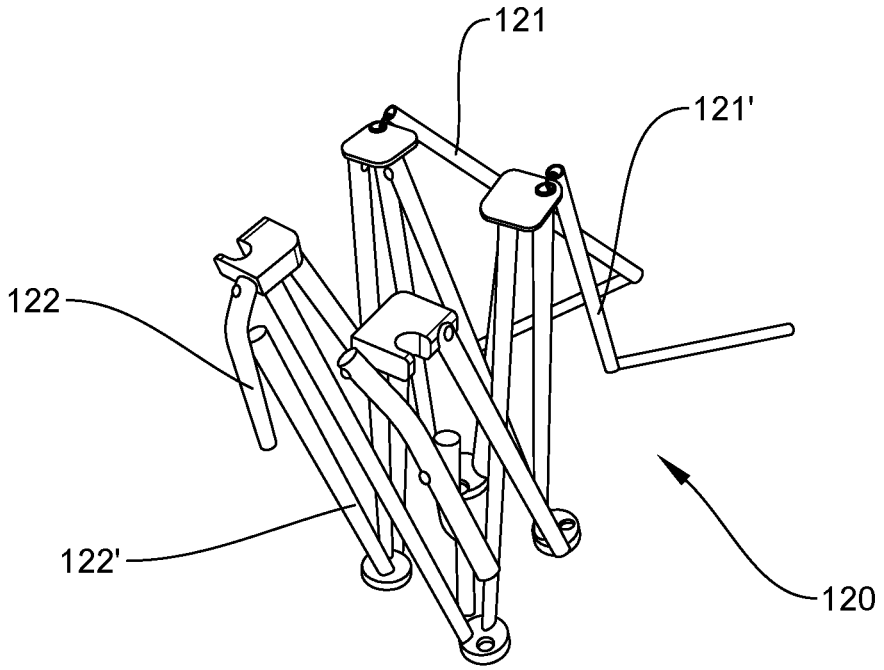
FIG. 2 illustrates a schematic view of the chair frame in the present invention when it is totally collapsed.

In one aspect, referring to FIGS. 1 to 6, a foldable chair 100 may include a fabric 110 and a chair frame 120. The chair frame 120 may include rear supporting rods (121, 121'), first front supporting rods (122, 122'), second front supporting rods (123, 123'), and a supporting base 124. In one embodiment, as shown in FIG. 2, each rear supporting rods (121, 121') may include a plurality of rear connecting rods that can be telescopically connected to form each rear supporting rod.

In one embodiment, the rear supporting rods (121, 121') extend upwards from a rear portion of the supporting base 124, while the first front supporting rods (122, 122') extend from one side of a front portion of the supporting base 124, and the second front supporting rods (123, 123') extend from the other side of the front portion of the supporting base 124.

Figure 3:
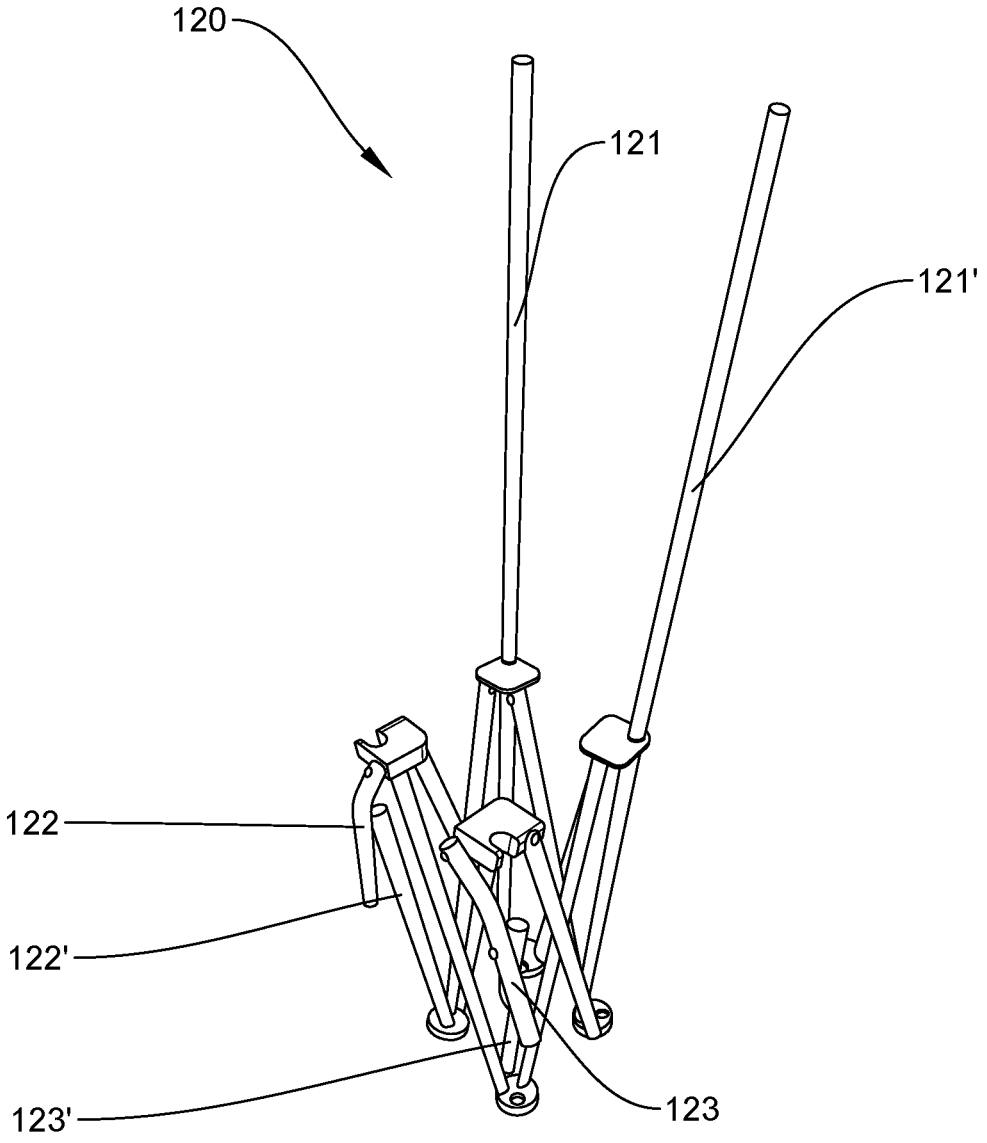
FIG. 3 illustrates a schematic view of the chair frame in the present invention when it is partially collapsed.
Figure 4:
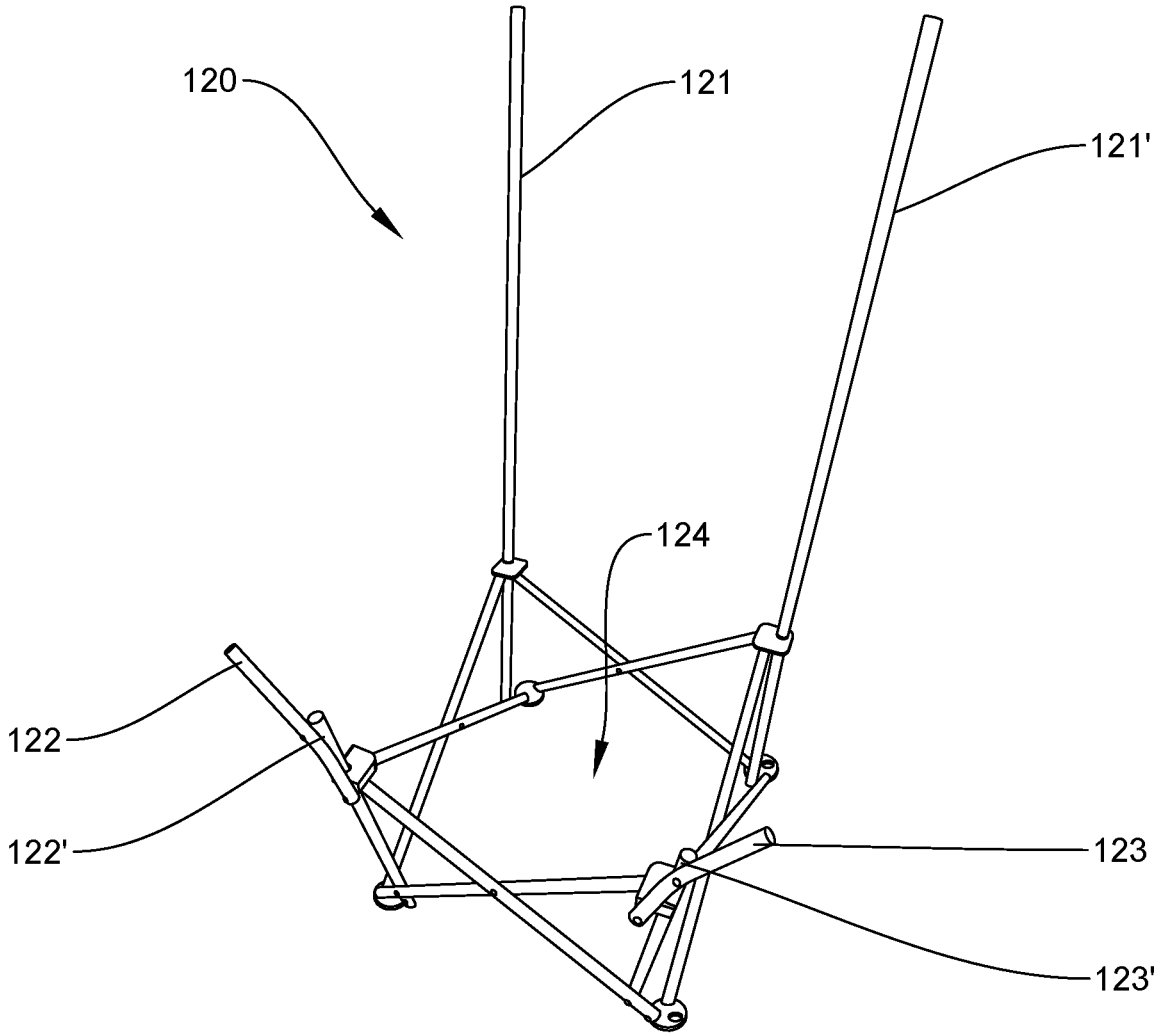
FIG. 4 illustrates a schematic view of the chair frame in the present invention when it is in the extended configuration.

Similarly, one of the first front supporting rods 122 and one of the second front supporting rods 123 can be telescopically formed as shown in FIGS. 2 and 3. The supporting base 124 has a plurality of base connecting rods forming substantially four sides of the supporting base 124. Each side may include two base connecting rods forming a single scissor hinge structure pivotally interconnecting with each other and other base connecting rods on two nearby sides as shown in FIG. 4.

Figure 5:
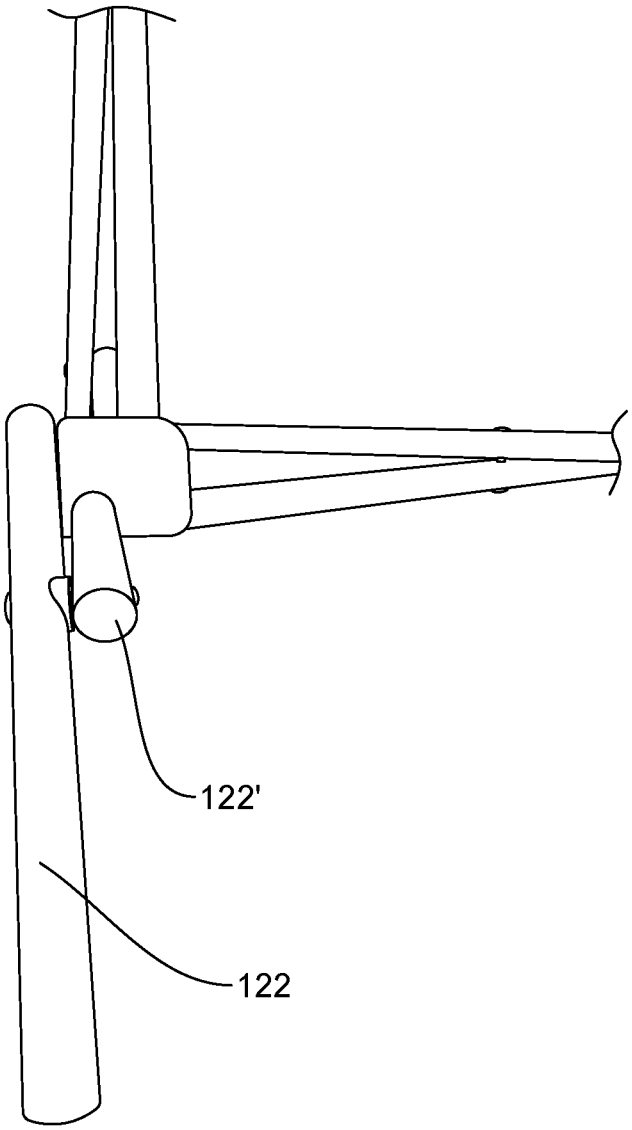
FIG. 5 illustrates a partially enlarged view of the first front supporting rods.

It is important to note that the chair structure can be more stable and strengthened when the first front supporting rods (122, 122') move away from each other in an extend configuration as shown in FIG. 5, as well as the second front supporting rods (123, 123'). When the fabric 110 is put on the chair frame 120, the first front supporting rods (122, 122') are disposed in a first pocket 111 of the fabric, while the second front supporting rods (123, 123') are disposed in a second pocket 112. Due to tension in the fabric seat (e.g., from elasticity of the fabric), the elasticity of the fabric, the first front supporting rods (122, 122') can be further separated to extend from the inward pulling by the first pocket 111, as well as the second front supporting rods (123, 123') in the second pocket 112, so the entire chair structure can be strengthen and becomes more stable.

When the chair is in use, for example, a user is sitting on the fabric 110, and under the weight of the fabric, the pockets (111, 112) of the fabric pulls the ends of the first front supporting rods (122, 122') and the second front supporting rods (123, 123') inwards, thus applying an external force to bias the first and second front supporting rods to extend against the other parts of the support base, so the chair structure can be more strengthened and stable. In other words, when the chair is in use, the user's weight helps the chair reach its most stable status.

When the chair is not in use, it is easy to fold because the supporting rods (121, 121', 122, 122', 123, 123') are telescopically connected and they can be folded as shown in FIG. 2. Moreover, since the supporting base 124 is formed by two base connecting rods on each side with a single scissor hinge structure pivotally interconnecting with each other and other base connecting rods, the size of the supporting base 124 can also be easily minimized as shown in FIG. 2.

With the foregoing discussion in reference to a foldable chair as background, the inventive concept of the foldable support base of the present invention will be explained in greater detail below, in reference to terminologies consistent with the claims to be presented. The following discussions further elaborate on the structure of the foldable support base for the foldable chair in the embodiment discussed above, followed by discussions of the structure of additional embodiments directed a foldable swing chair (FIGS. 7A-7C) and a foldable hammock (FIGS. 8A-8C) incorporating the inventive foldable support base. These embodiments highlight the base inventive concept, as the foldable support bases for the foldable chair, foldable swing chair and foldable hammock are substantially similar with some variations consistent with the respective embodiments.

Figure 6A:
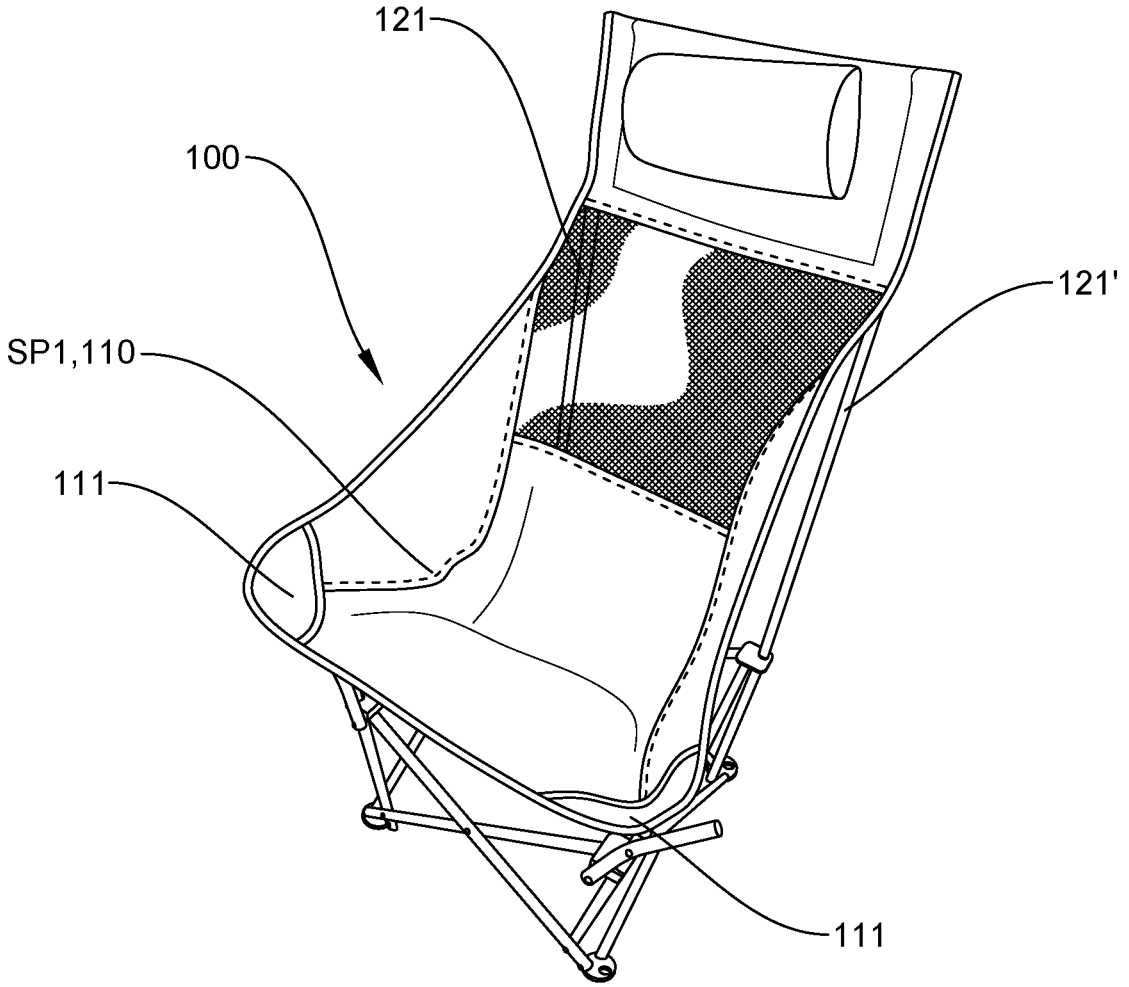
FIG. 6A illustrates a perspective view of a foldable chair incorporating the foldable support base in accordance with one embodiment of the present invention.
Figure 6B:
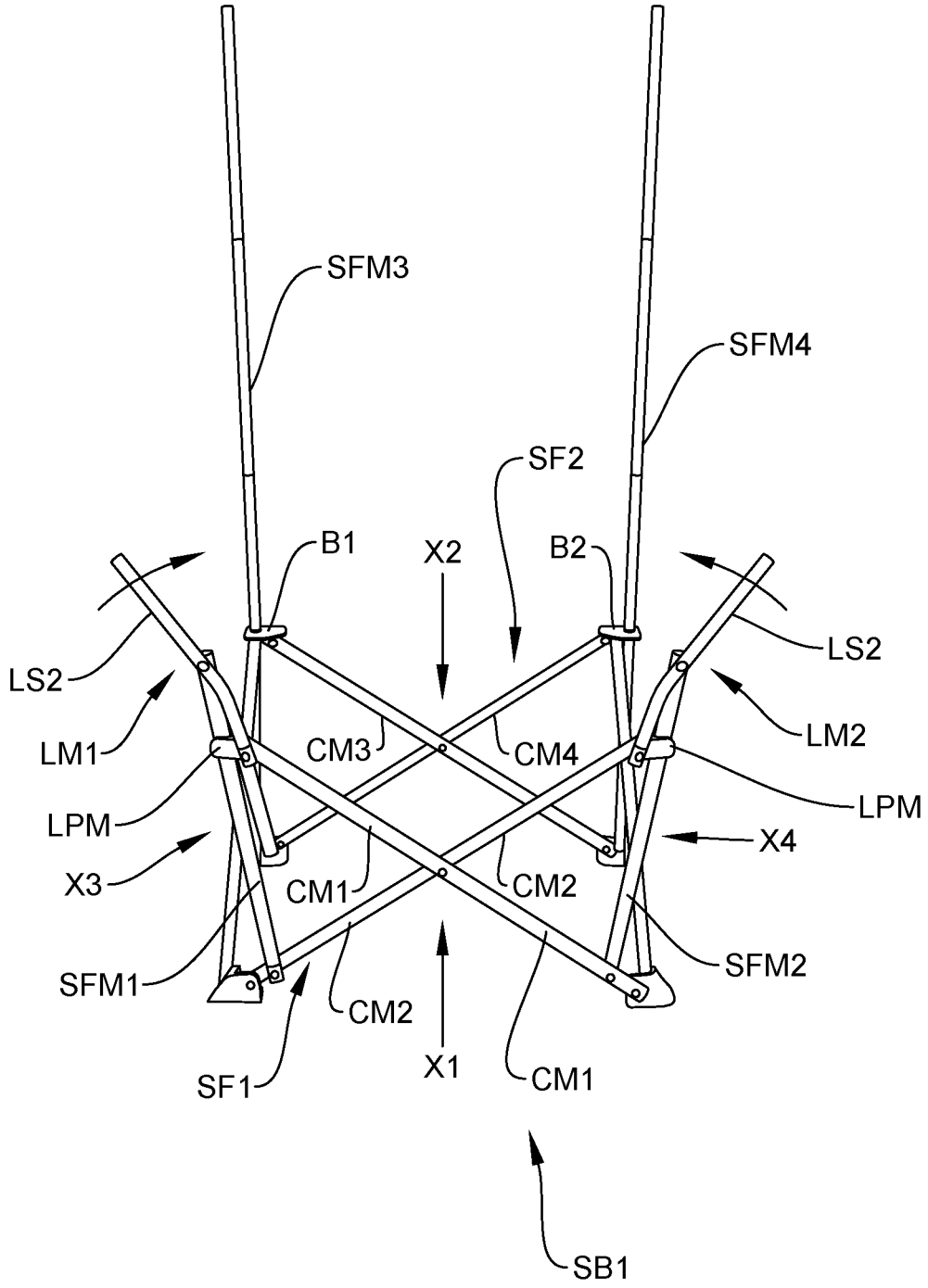
FIG. 6B is a front perspective view of the foldable support base of the foldable chair without the fabric seat.
Figure 6C:
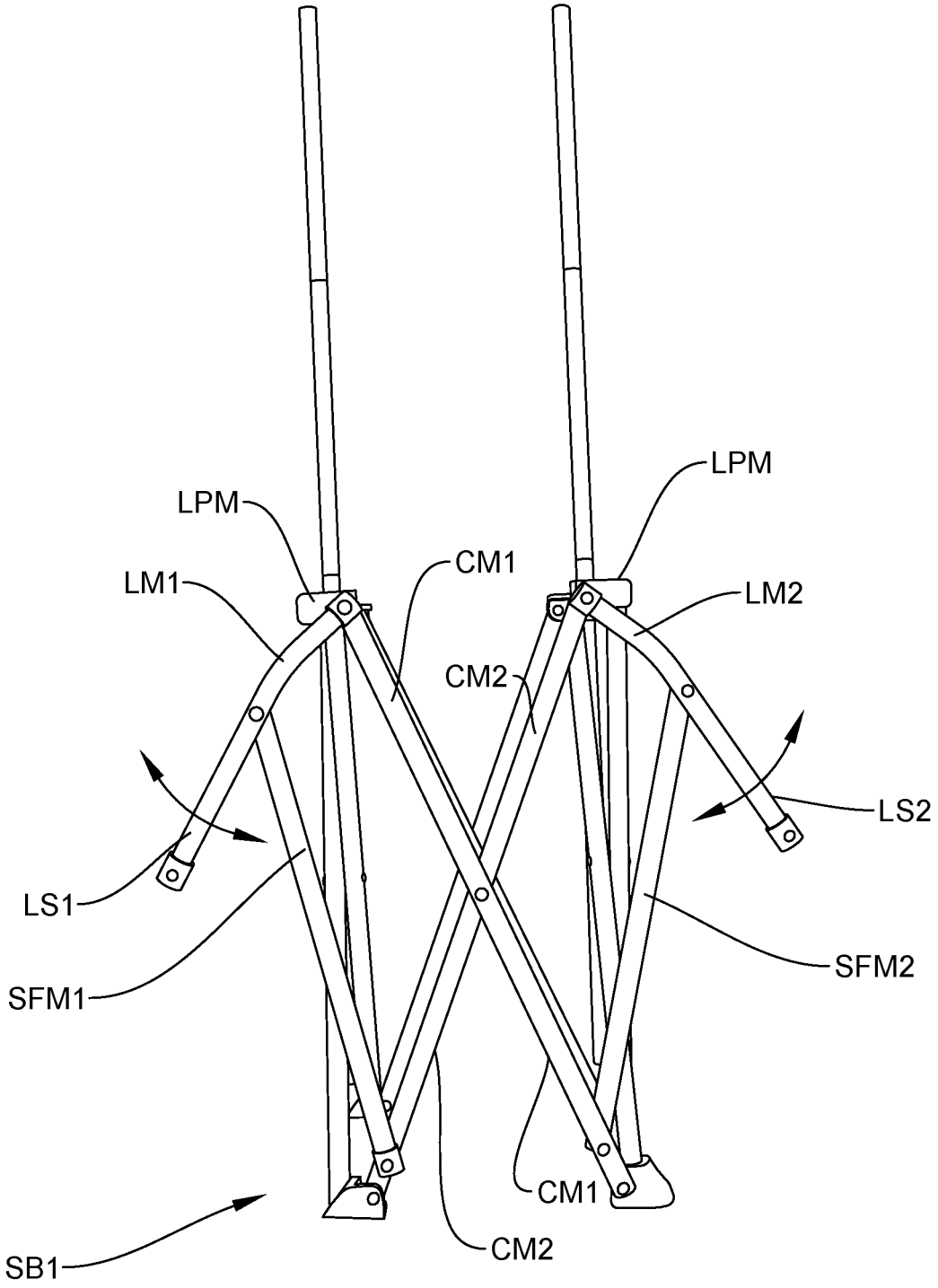
FIG. 6C is a front view of the foldable support base.
Figure 6D:
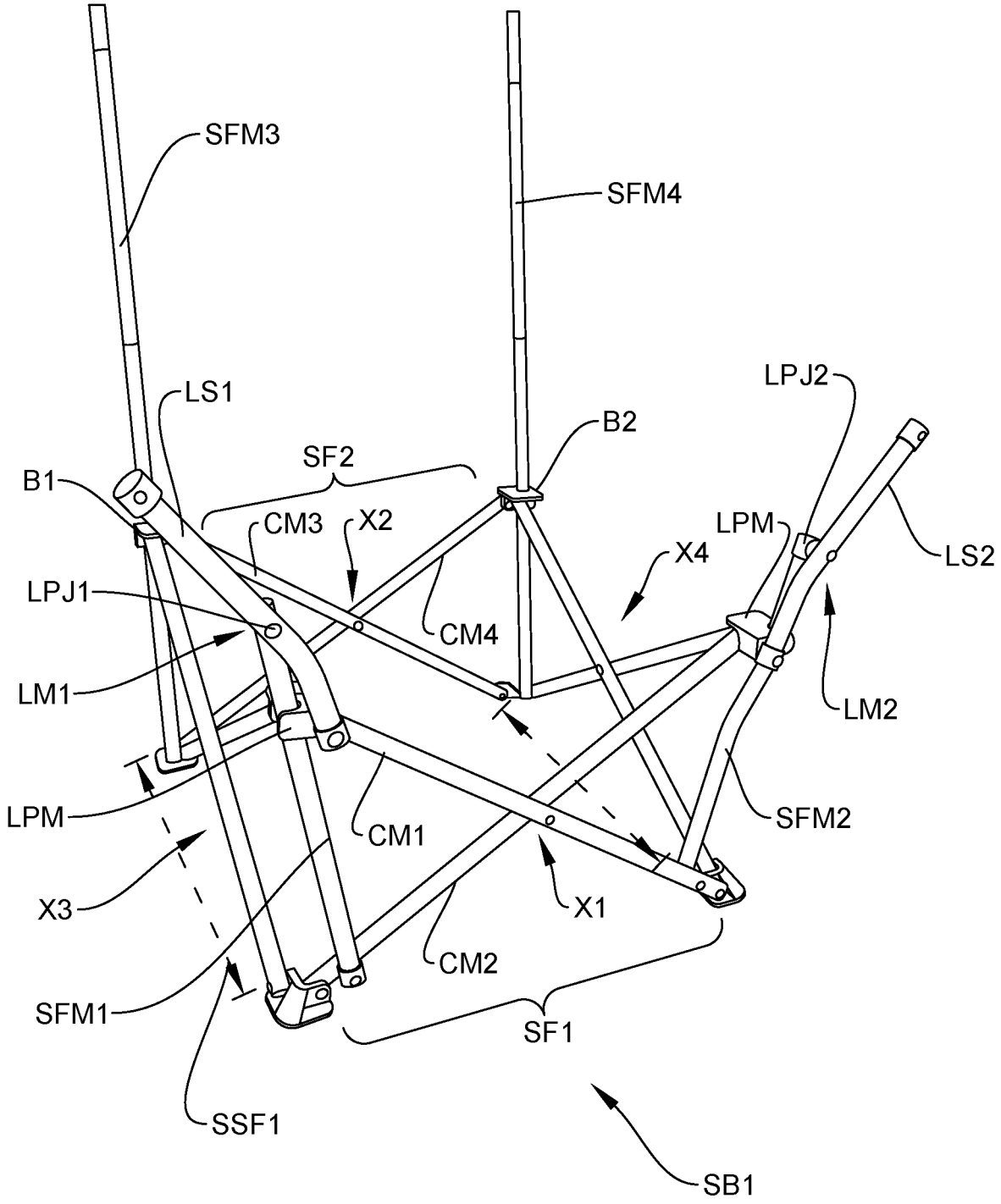
FIG. 6D is a perspective view of the foldable support base.

Referring to FIGS. 6A to 6D (without flexible user support platform, or in this case a seat fabric, remove), the present invention is directed a foldable support base SB1 for a foldable furniture with a flexible user support platform, comprising a first support frame SF1 and a supplemental support frame SSF1 coupled to the first support frame SF1 to complete the foldable support base. In the embodiment of FIG. 6D, the first support frame SF1 corresponds to a support frame at the front of the chair, and the supplemental support frame SSF1 corresponds to the rest of the support base behind the front of the first support frame SF1.

The first support frame SF1 comprises a first load member LM1 at one side; a first side frame member SFM1 pivotally connected to the first load member LM1, wherein a top portion of the first side frame member SFM1 is pivotally connected to a first load pivot joint LPJ1 along the first load member LM1, and wherein a first load section LS1 of the first load member LM1 extends beyond the first load pivot joint LPJ1, which is pivotable about the first load pivot joint LPJ1 towards a center of the first support frame SF1. On the other side of the first support frame SF1, there is mirror image of the structure on the side discussed above, namely, a second load member LM2; a second side frame member SFM2 pivotally connected to the second load member LM2. A top portion of the second side frame member SFM2 is pivotally connected to a second load pivot joint LPJ2 along the second load member LM2. A second load section LS2 of the second load member LM2 extends beyond the second load pivot joint LPJ2, which is pivotable about the second load pivot joint LPJ2 towards a center of the first support frame SF1. A first collapsible connecting frame CCF1 is pivotally connected at a first side to a proximate end of the first load member LM1 and the first side frame member SFM1, and pivotally connected at a second side to a proximate end of the second load member LM2 and the second side frame member SFM2. The first collapsible connecting frame CCF1 can be configured between an extended configuration in which the first and second side frame members SFM1 and SFM2 are spread to spaced apart from each other (see also FIG. 4) and a collapsed configuration in which the first side frame member SFM1 is brought close to the second side frame member SFM1 (see also FIGS. 1, 2 and 3).

The first and second load sections LS1 and LS2 of the first and second load members LM1 and LM2 are configured for removably attaching a flexible user support platform SP1 (see also fabric 110 in FIG. 6A therebetween. A load on the flexible user support platform SP1 would result in a force component pulling on the load sections LS1 and LS2 of the first and second load members LM1 and LM2 to cause the first and second load members LM1 and LM2 to pivot about the respective first and second load pivot joints LPJ1 and LPJ2 in a direction towards the flexible user support platform SP1, thereby biasing the first collapsible connecting frame CCF1 to keep the first and second side frame members SFM1 and SFM2 to be spaced apart to maintain the first collapsible connecting frame CCF1 in the extended configuration shown in FIGS. 6B and 6D.

The first collapsible connecting frame CCF1 comprises a first scissor hinge structure X1 pivotally interconnecting between the proximate end of the first load member LM1 and a bottom portion of the first side frame member SFM1 at the first side, and the proximate end of the second load member LM2 and a bottom portion of the second side frame member SFM2 at the second side. In this embodiment, the first scissor hinge structure X1 comprises a single scissor hinge comprising a first connecting member CM1 and a second connecting member CM2, wherein the first and second connecting members CM1 and CM2 are pivotally connected to each other at a substantially pivotal center of the first scissor hinge structure X1. A first end of the first connecting member CM1 is pivotally connected to the proximate end of the first load member LM1, and a second end of the first connecting member CM1 is pivotally connected to the lower portion of the second side frame member SFM2, and a first end of the second connecting member CM2 is pivotally connected to the proximate end of the second load member LM2, and a second end pivotally connected to the lower portion of the first side frame member SFM1.

As shown in FIG. 6D, the supplemental support frame SSF1 comprises a plurality of frame members pivotally coupled to the first collapsible connecting frame CCF1. In this embodiment, the supplemental support frame SSF1 comprises: a second support frame SF2; and an interconnecting frame pivotally interconnecting between the first support frame SF1 and the second support frame SF2. The second scissor hinge structure X2 comprises a third connecting member CM3 and a fourth connecting member CM4, wherein the third and fourth connecting members CM3 and CM4 are pivotally connected to each other at a substantially pivotal center of the second scissor hinge structure X2. A first end of the third connecting member CM3 is pivotally and slidably coupled to a third side frame member SFM3, and a second end of the third connecting member CM3 is pivotally connected to the lower portion of a fourth side frame member SFM4. A first end of the fourth connecting member CM4 is pivotally and slidably coupled to the fourth side frame member SFM4, and a second end of the fourth connecting member CM4 is pivotally connected to the lower portion of the third side frame member SFM3. The slidable couplings by means of slidable pivot blocks B1 and B2 to slide up and down the third and fourth side frame members SFM3 and SFM4, when transitioning between the extended and collapsed configurations of the support base SB1. It is noted that the rear second support frame SF2 need not include load members, as the front of the flexible support platform SP1 takes up more of the weight of the user sitting on the platform SP1.

The interconnecting frame comprises a pair of supplemental collapsible connecting frames SCCF1 and SCCF2 respectively pivotally connected at a first side to the first support frame SF1 and at a second side to the second support frame SF2. The pair of supplemental collapsible connecting frames SCCF1 and SCCF2 can be configured between an extended configuration in which the first and second support frame SF1 and SF2 are spaced apart and a collapsed configuration in which the first support frame SF1 is brought close to the second support frame SF2. Scissor hinge structures X3 and X4 are provided. The third scissor hinge structure X3 pivotally connecting at its first side to the bottom portion of the first side frame member SFM1 and the top portion of SFM1/the first end of the first connecting member CM1 of the first scissor hinge structure X1, and pivotally connecting at its second side to the bottom portion of the third side frame member SFM3 and the top portion of the SFM3/the first end of the third connecting member CM3 (at the sliding block B1) of the second scissor hinge structure X2. The fourth scissor hinge structure X4 pivotally connecting at its first side to the bottom portion of the second side frame member SFM2 and the top portion of the second side frame member SFM2/the first end of the second connecting member CM2 of the first scissor structure X1, and pivotally connecting at its second side to the bottom portion of the fourth side frame member SFM4 and pivotally connected to the second end of the fourth connection member CM4 (at the sliding pivot block B2) of the second scissor hinge structure X2.

The bottom of the scissor hinge structures X1, X2, X3 and X4 correspond to four of the support base SB1 for resting on an external support surface, such as a ground.

Given the collapsible connecting frames CCF1 and CCF2 and supplemental collapsible connecting frames SCCF1 and SCCF2, the entire support base SB1 can be extended between a fully collapsed configuration shown in FIG. 1 to a fully extended configuration shown in FIG. 6D (ready to be covered with the flexible support platform SP1).

Referring also to FIG. 5 (which depicts the second side frame member SFM2 region, which is a mirror image of the first side frame member SFM1 region), the first end of the first connecting member CM1 of the first scissor structure X1 is pivotally connected to the proximate end of the first load member LM1 by a locking pivot member LPM structured to snap tightly to latch onto a first side frame member SFM1. Referring to FIG. 6C, in a partially extended configuration between the fully extended configuration and the collapsed configuration of the support base SB1, pivotal connections of the first side frame member SFM1, first load member LM1, the first connection member CM1 and the second connecting member CM2 are linkages resulting in a structure corresponding to a quadrilateral. Referring to FIG. 6B, in the fully extended configuration under the load on the flexible user support platform SP1, the first load section LS1 of the first load member LM1 pivots towards the center of the support base SB to press the locking pivot member LPM against the first side frame member SFM1 to lock against the first side frame member SFM1, thereby reducing a linkage to result in remaining linkages CM1, CM2 and SFM1 in a triangular structure corresponding to a simple support truss structure, which is a sturdy and strong support structure. The same truss structure is also present at the side of the second side frame member SFM2 and load member LM2.

Figure 7A:
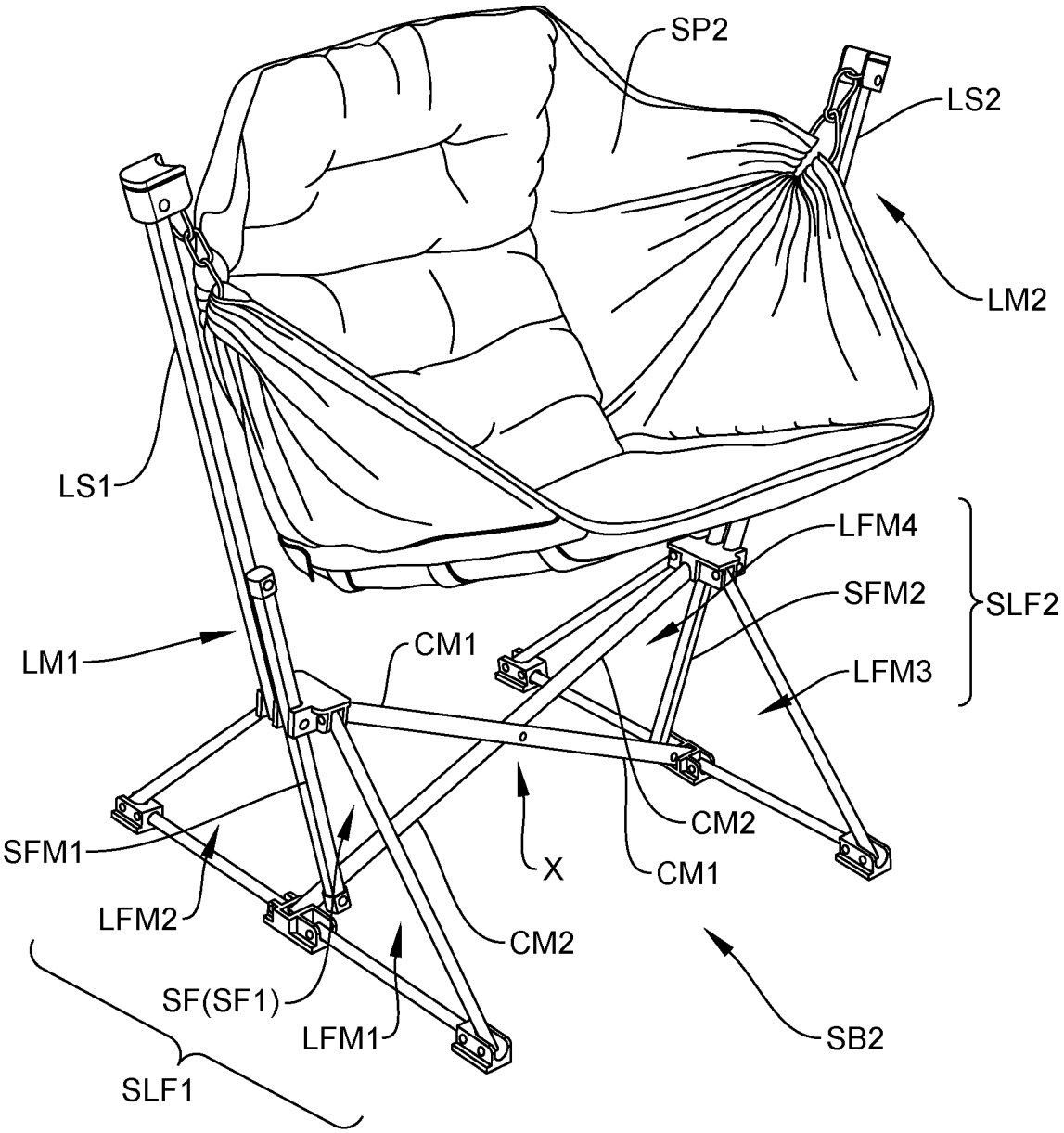
Figure 7B:
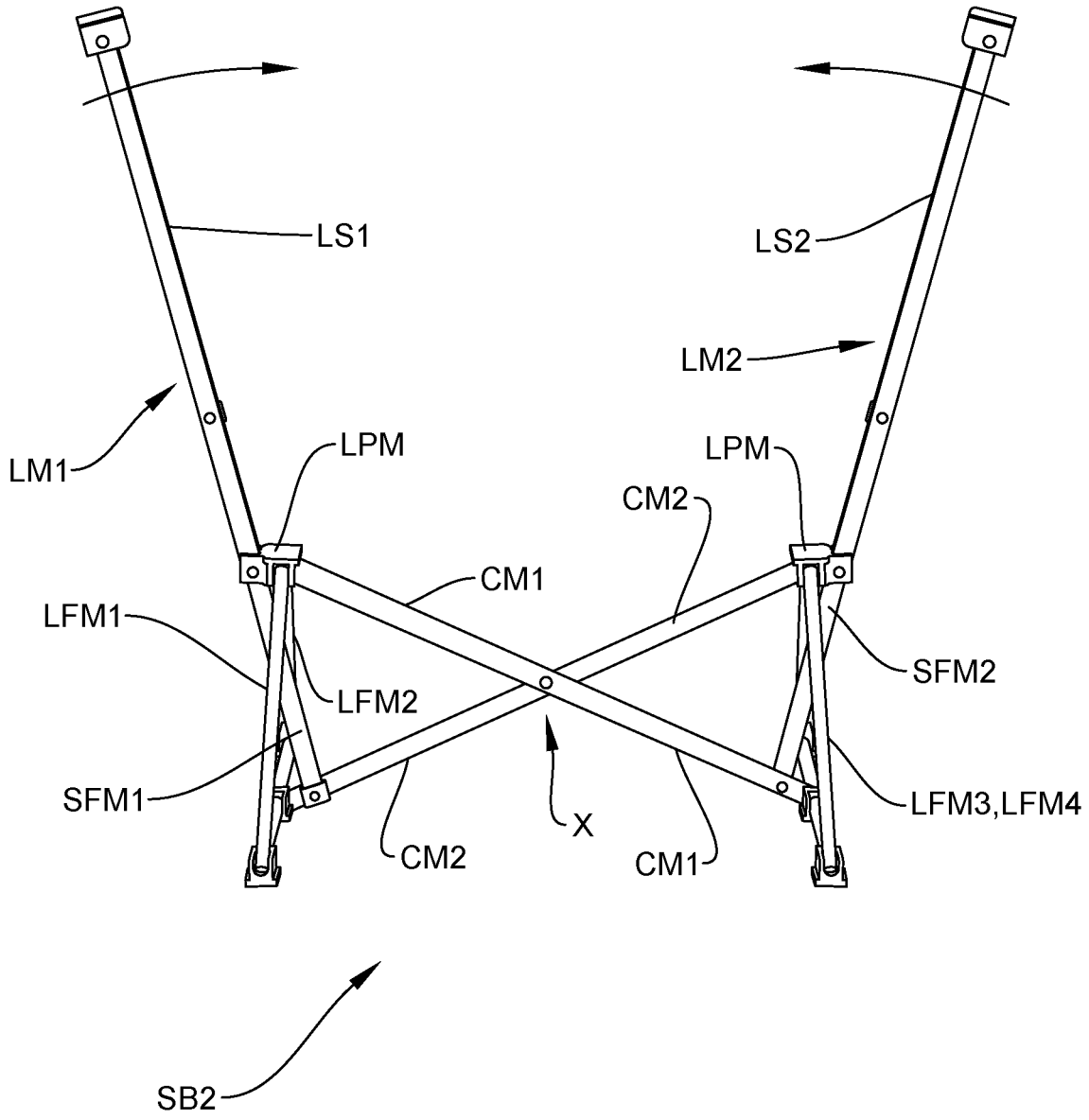
Figure 7C:
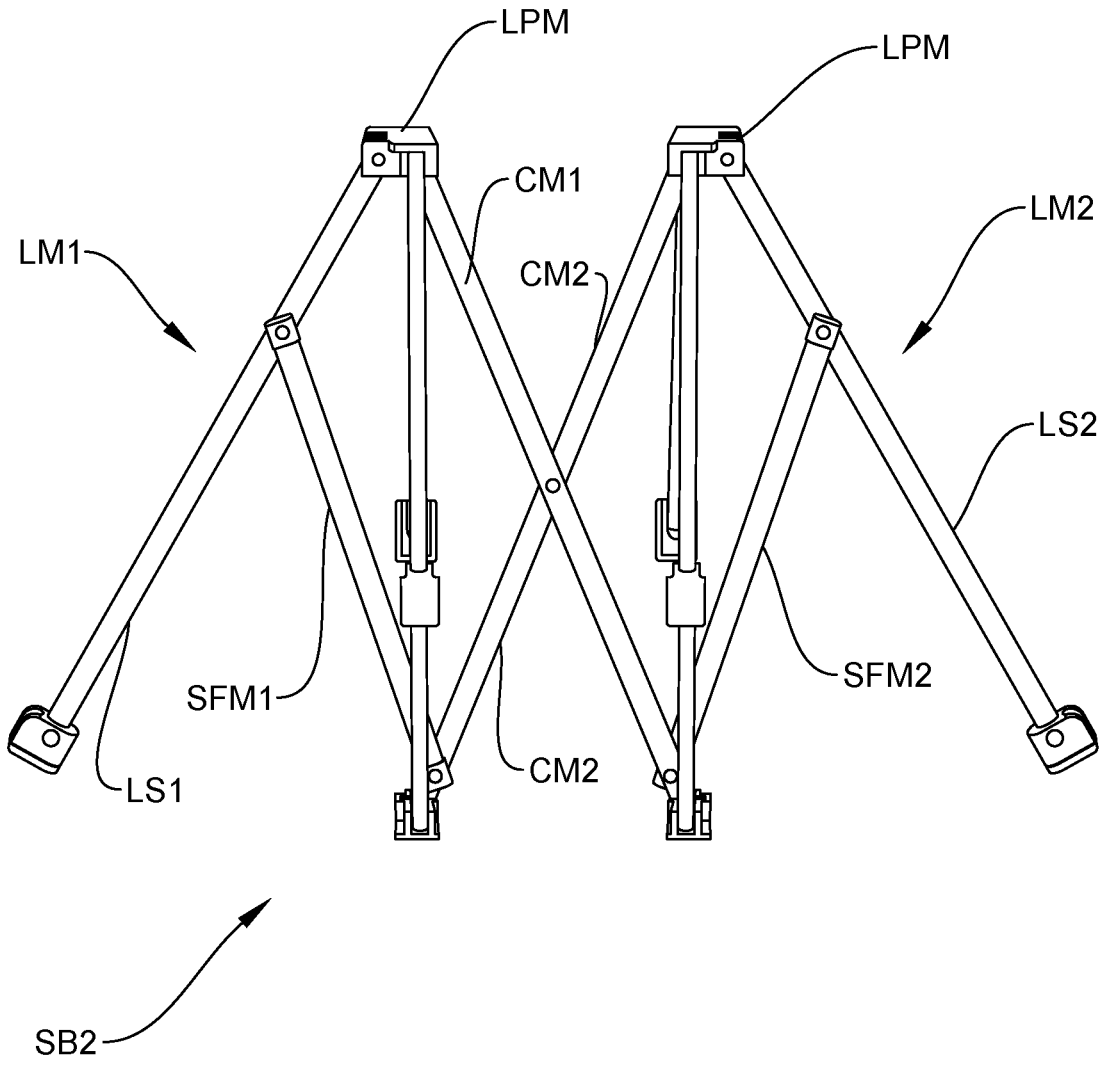

FIGS. 7A to 7C are views corresponding to the views of FIGS. 6A to 6C for comparisons, wherein FIG. 7A illustrates a perspective view of a foldable swing chair incorporating the foldable support base in accordance with another embodiment of the present invention; FIG. 7B is a front perspective view of the foldable support base of the foldable swing chair without the fabric seat; FIG. 7C is a front view of the foldable support base for the swing chair in a partially collapsed configuration. As can be seen by comparison of the foldable swing chair embodiment in FIG. 7 to the foldable chair embodiment in FIG. 6, the basic support frame SF in the support base SB2 is very similar to the basic support frame SF1 in the support base SB1. Only the differences between the two embodiments will be mentioned below. Components corresponding to the first support frame SF1 in the previous embodiment are similarly labeled in the support base SB2 in FIG. 7.

In this embodiment, the foldable support base SB2 has only a single support frame SF, which is very similar to the first support frame SF1 in FIG. 6. In this embodiment, the relative sizes of the frame members are different from that in the first support frame SF1 in FIG. 6, but the overall mechanical structure is quite similar. The support frame SF is support by a supplemental support frame SSF2, comprising pivotally connected members on either side of the support frame SF. The flexible support platform SP2 is a seat in the form of a flexible bucket having a rigid seating bottom. Its two sides are hung from the top of the load sections LS1 and LS2 of the load members LM1 and LM2. The load sections LS1 and LS2 of the load members LM1 and LM2 in this embodiment are longer than the load sections and load members in the previous embodiment, as they directly support the load of a user sitting on the swing chair.

The supplemental support frame SSP2 includes a first support leg frame SLF1 supporting the first side frame member SFM1, and a second support leg frame SLF2 supporting the second side frame member SFM2. The first support leg frame SLF1 comprises a first set of first and second leg frame members LFM1 and LFM2 extending from each side of the first side frame member SFM1, and the second support leg frame comprises a second set of leg frame members LFM3 and LFM4 extending from each side of the second side frame member SFM2.

The first end of the first connecting member CM1 of the scissor structure X is pivotally connected to the proximate end of the first load member LM1 by a locking pivot member LPM structured to snap tightly to latch onto a first side frame member SFM1. In this embodiment, given the single support frame SF, the locking pivot member LPM also structured to snap tightly to latch onto the first load member LM1. Referring to FIG. 7C, in a partially extended configuration between the fully extended configuration and the collapsed configuration of the support base SB2, pivotal connections of the first side frame member SFM1, first load member LM1, the first connection member CM1 and the second connecting member CM2 are linkages resulting in a structure corresponding to a quadrilateral. Referring to FIG. 7B, in the fully extended configuration under the load on the flexible user support platform SP2, the first load section LS1 of the first load member LM1 pivots towards the center of the support base SB2 to press the locking pivot member LPM against the first side frame member SFM1 to lock against the first side frame member SFM1, thereby reducing a linkage to result in remaining linkages CM1, CM2 and SFM1 in a triangular structure corresponding to a simple support truss structure, which is a sturdy and strong support structure. The same truss structure is also present at the side of the second side frame member SFM2 and load member LM2.

Figure 8A:
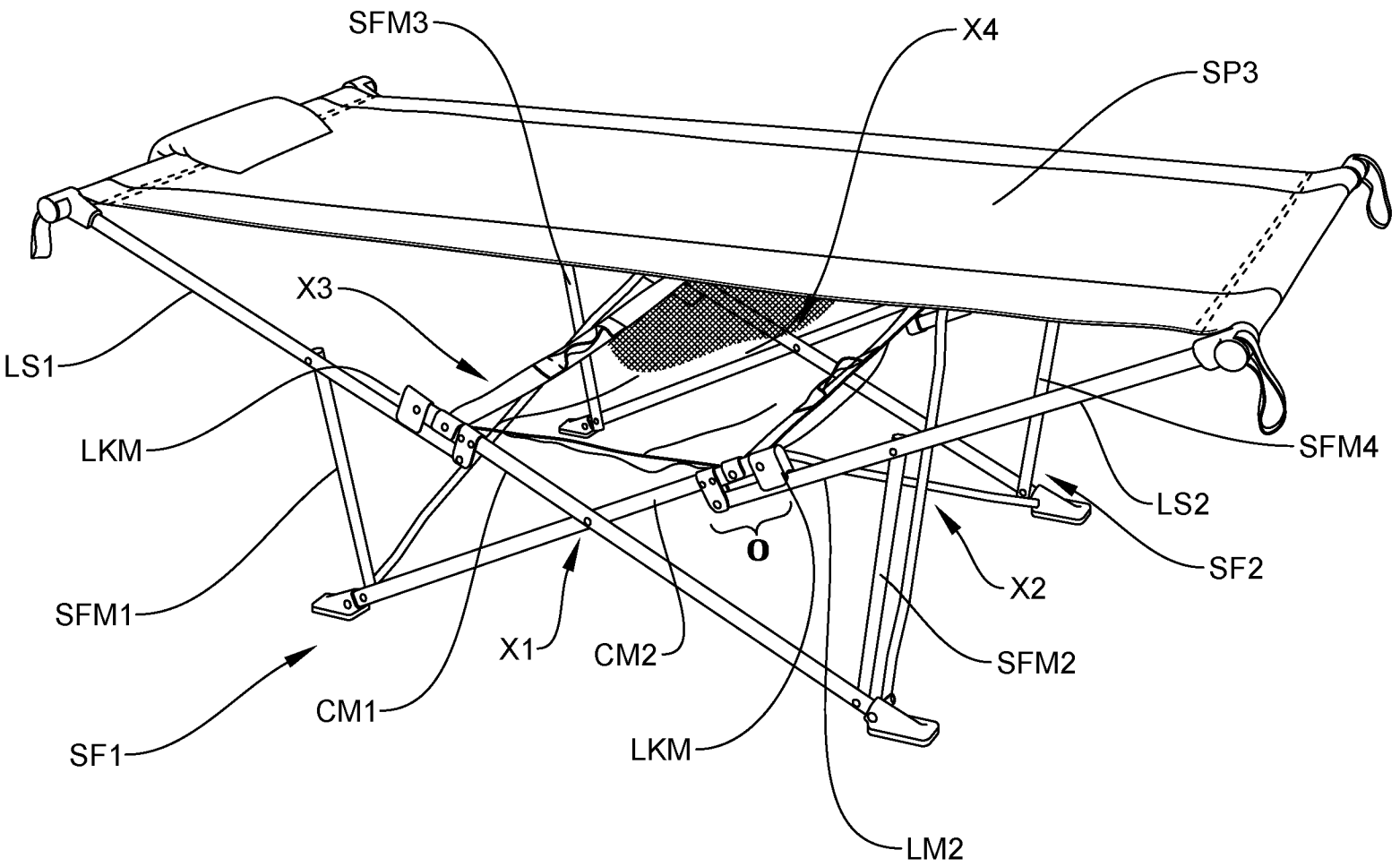
Figure 8B:
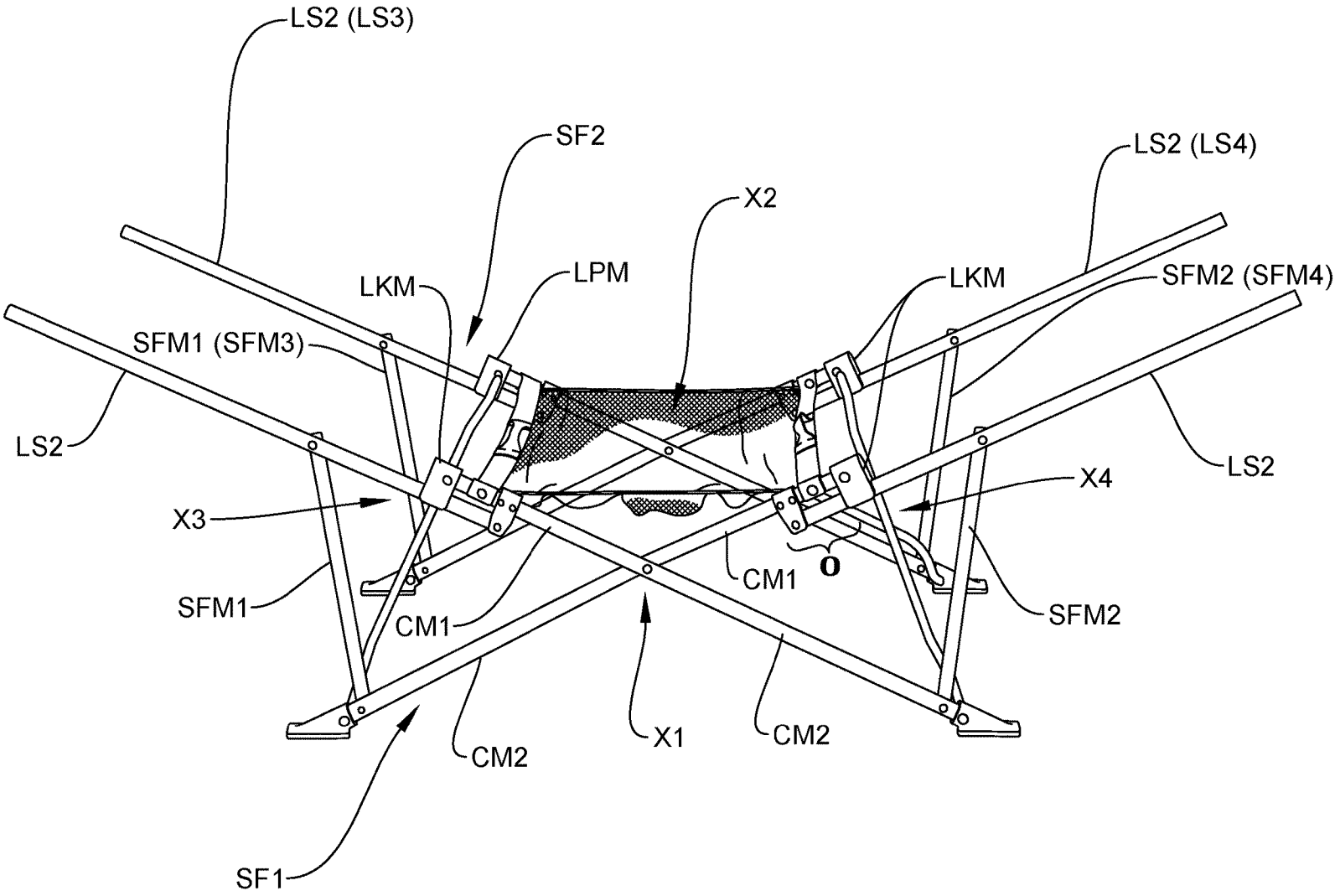
Figure 8C:
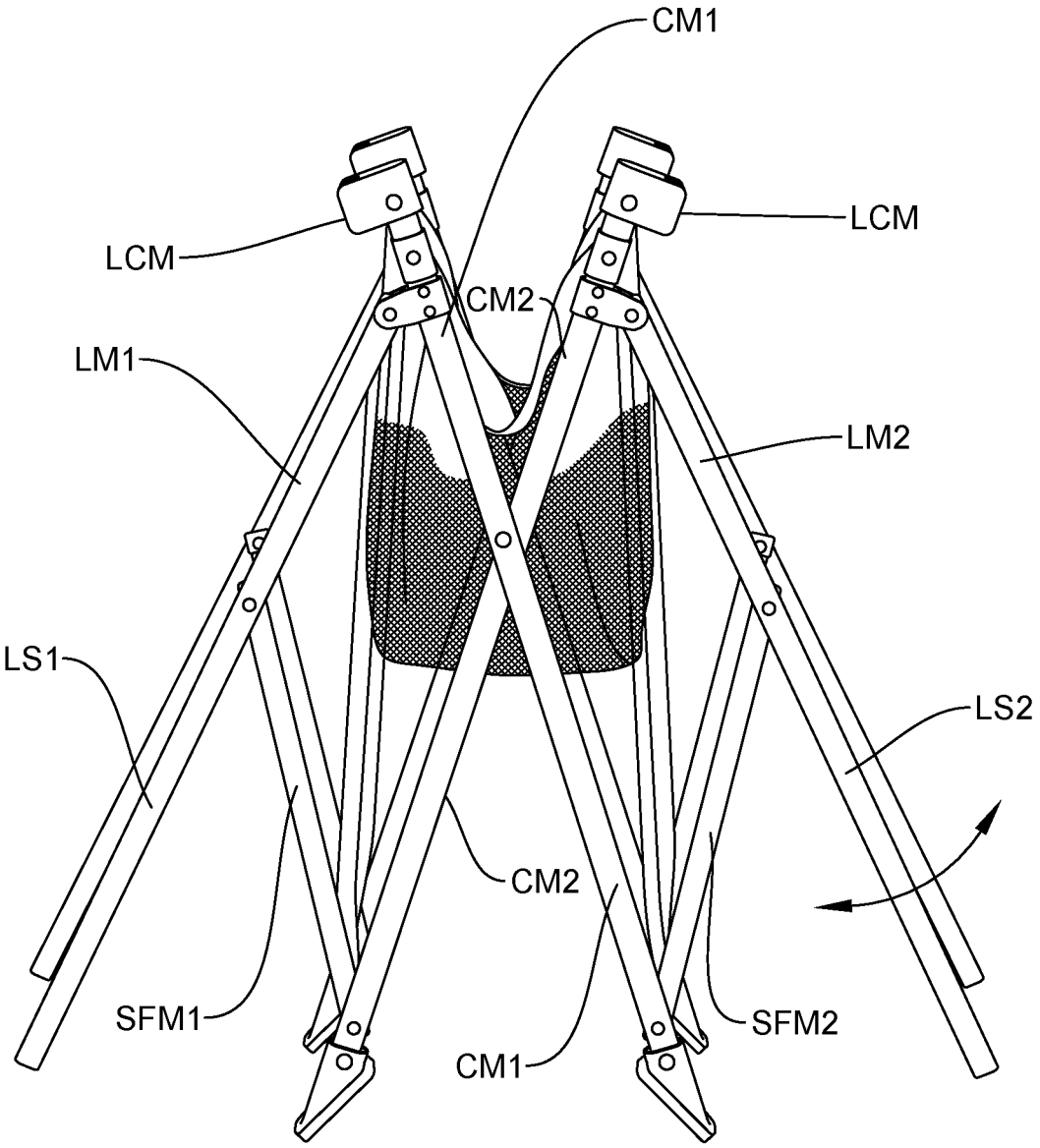

FIGS. 8A to 8C are views corresponding to the views of FIGS. 6A to 6C and FIGS. 7A to 7C for comparisons, wherein FIG. 8A illustrates a perspective view of a foldable hammock incorporating the foldable support base in accordance with another embodiment of the present invention; FIG. 8B is a front perspective view of the foldable support base of the foldable hammock without the hammock bed; FIG. 8C is a front view of the foldable support base for the foldable hammock in a partially collapsed configuration. As can be seen by comparison of the foldable hammock embodiment in FIG. 8 to the foldable chair embodiment in FIG. 6 and foldable swing chair embodiment in FIG. 7, the base support frame SF1 and SF2 in the support base SB3 is very similar to that in the support frame SF1 and SF2, except for the slidable coupling to the third and fourth side frame members and the presence of load members in the support frame SF2. Only the differences from the embodiment of FIG. 6 will be mentioned below. Components corresponding to the first support frame SF1 in the previous embodiment are similarly labeled in the support base SB3 in FIG. 8.

In this embodiment, the relative sizes of the frame members are different from that in the first support frame SF1 in FIG. 6, but the overall mechanical structure is quite similar. Unlike the previous embodiments, the hammock support base SB3 has a pair of support frames SF1 and SF2, which are structurally similar (i.e., mirror image of each other). The supplemental support frame SSF3 comprises the second support frame SF2, which comprises a structure similar to the first support frame SF1; and an interconnecting frame interconnecting between the first support frame SF1 and the second support frame SF2. Given the pair of support frames SF1 and SF2 are structurally similar, only the features of the first support frame SF1 of the support base SB3 will be discussed herein. It is understood that the same structures are present in the support frame SP2. The flexible support platform SP3 is longitudinal soft bed having its two ends are hung from the top of the load sections LS1 and LS2 of the load members LM1 and LM2 of the support frame SF1. The load sections LS1 and LS2 of the load members LM1 and LM2 in this embodiment are longer than the load sections and load members in the previous embodiment of FIG. 6, as they directly support the load of a user laying down on the hammock bed.

The corresponding components are similarly labeled on the first support frame SP1 (and also second support frame SP2). The second support frame SF2 comprises: a third load member; a third side frame member pivotally connected to the third load member, wherein a top portion of the third side frame member is pivotally connected to a third load pivot joint along the third load member, and wherein a third load section of the third load member extends beyond the third load pivot joint, which is pivotable about the third load pivot joint towards a center of the second support frame; a fourth load member; a fourth side frame member pivotally connected to the fourth load member, wherein a top portion of the fourth side frame member is pivotally connected to a fourth load pivot joint along the fourth load member, and wherein a fourth load section of the fourth load member extends beyond the fourth load pivot joint, which is pivotable about the first load pivot joint towards a center of the second support frame; and a second collapsible connecting frame pivotally connected at a first side to a proximate end of the third load member and the third side frame member, and pivotally connected at a second side to a proximate end of the fourth load member and the fourth side frame member, wherein the pair of connecting frame members can be configured between an extended configuration in which the third and fourth side frame members are spread to be spaced apart from each other and a collapsed configuration in which the third side frame member is brought close to the fourth side frame member, wherein the third and fourth load sections of the third and fourth load members are configured to further removably attach the flexible user support platform therebetween, and wherein a load on the flexible user support platform results in a force component pulling on the load sections of the third and fourth load members to cause the third and fourth load members to pivot about the respective third and fourth load pivot joints in a direction towards the flexible user support platform, thereby biasing the second collapsible connecting frame to keep the third and fourth side frame members to be spaced apart to maintain the second collapsible connecting frame in the extended configuration. (Herein, for the second support frame SF2, the 'third' components correspond to respective "first" components, and "fourth" components correspond to respective "second" components.)

The interconnecting frame comprises a pair of supplemental collapsible connecting frames SCCF 1 and SCCF2 respectively pivotally connected at a first side to the first support frame SF1 and at a second side to the second support frame SF2, and wherein the pair of supplemental collapsible connecting frames SCCF1 and SCCF2 can be configured between an extended configuration in which the first and second support frame SF1 and SF2 are spaced apart and a collapsed configuration in which the first support frame SF1 is brought close to the second support frame SF2.

The pair of supplemental collapsible connecting frames comprises: a third scissor hinge structure pivotally connecting at its first side to the bottom portion of the first side frame member and the proximate end of the first load member, and pivotally connecting at its second side to the bottom portion of the third side frame member and the proximate end of the third load member; and fourth scissor hinge structure pivotally connecting at its first side to the bottom portion of the second side frame member and the proximate end of the second load member, and pivotally connecting at its second side to the bottom portion of the fourth side frame member and the proximate end of the fourth load member.

Accordingly, unlike the embodiment in FIG. 7, the third scissor hinge structure X3 pivotally connects at its second side to the bottom portion of the third side frame member and the proximate end of the third load member instead of the first end of the third connecting member of the second scissor hinge structure. Further, the fourth scissor hinge structure X4 pivotally connects at its second side to the bottom portion of the fourth side frame member and the proximate end of the fourth load member instead of the end of the fourth connection member. Similar structural differences for the other components mirror the above. In another aspect, the present invention is directed to a foldable furniture for supporting a user for resting, comprising: a foldable support base as described herein; and a flexible user support platform removably attached to the first and second load sections of the first and second load members of the foldable support base.

In this embodiment, referring to FIGS. 8A and 8B the first end of the first connecting member of the first scissor structure X1 is pivotally connected to the proximate end of the first load member with an overlapping region O between the first end of the first connecting member CM1 and the proximate end of the first load member LM1 when the first load member LM1 is pivoted to be parallel to the first connection member CM1, wherein in the extended configuration under the load on the flexible user support platform, the first load member pivots to press a side of the first end of the first connecting member CM1 against a side of the proximate end of the first load member LM1 to be parallel in the overlapping region O, thereby reducing a linkage to result in remaining linkages in a triangular structure corresponding to a simple support truss structure.

More specifically, a locking member LKM, having a snap configuration similar to the previous embodiments, is attached at one of the proximate end of the first load member LM1 or the end of the first connecting member CM1, which is configured to snap tightly to latch onto the other member (CM1 or LM1 as the case may be). Referring to FIG. 8C, in a partially extended configuration between the fully extended configuration and the collapsed configuration of the support base SB3, pivotal connections of the first side frame member SFM1, first load member LM1, the first connection member CM1 and the second connecting member CM2 are linkages resulting in a structure corresponding to a quadrilateral. Referring to FIG. 8B, in the fully extended configuration under the load on the flexible user support platform SP3, the first load section LS1 of the first load member LM1 pivots towards the center of the support base SB3 to press a side of the first end of the first connecting member CM1 against a side of the proximate end of the first load member LM1 to be parallel in the overlapping region O, thereby reducing a linkage to result in remaining linkages CM1/LM1 (one became an extension of the other or combined in a single linkage), CM2 and SFM1 in a triangular structure corresponding to a simple support truss structure, which is a sturdy and strong support structure. The same truss structure is also present at the side of the second side frame member SFM2 and load member LM2.

In all the above embodiments, to collapse the support bases (SB1, SB2, SB3), one can press down on the load sections LS of the respective load members M, the load sections LS are then pivoted/rotated in a direction away from the center of the support base, thus leveraging to release against the latch created by the locking pivot joints LPJ, the locking pivot members LPM or the locking members LKM to collapse the support bases into their collapsed configuration.

While the invention has been particularly shown and described with reference to the preferred embodiments, it will be understood by those skilled in the art that various changes in form and detail may be made without departing from the spirit, scope, and teaching of the invention. Accordingly, the disclosed invention is to be considered merely as illustrative and limited in scope only as specified in the appended claims.

The invention claimed is:

1. A foldable support base for a foldable furniture with a flexible user support platform, comprising:

a first support frame, which comprises:

a first load member;

a first side frame member pivotally connected to the first load member, wherein a top portion of the first side frame member is pivotally connected to a first load pivot joint along the first load member, and wherein a first load section of the first load member extends beyond the first load pivot joint, which is pivotable about the first load pivot joint towards a center of the first support frame;

a second load member;

a second side frame member pivotally connected to the second load member, wherein a top portion of the second side frame member is pivotally connected to a second load pivot joint along the second load member, and wherein a second load section of the second load member extends beyond the second load pivot joint, which is pivotable about the second load pivot joint towards a center of the first support frame;

a first collapsible connecting frame pivotally connected at a first side to a proximate end of the first load member and the first side frame member, and pivotally connected at a second side to a proximate end of the second load member and the second side frame member, wherein the first collapsible connecting frame is pivotally connected to the first load member by a first locking pivot member and pivotally connected to the second load member by a second locking pivot member and wherein the collapsible connecting frame can be configured between an extended configuration in which the first and second side frame members are spread to spaced apart from each other and a collapsed configuration in which the first side frame member is brought close to the second side frame member; and a supplemental support frame coupled to the first support frame to complete the foldable support base, wherein the first and second load sections of the first and second load members are configured for removably attaching a flexible user support platform therebetween, and wherein a load on the flexible user support platform results in a force component pulling on the load sections of the first and second load members to cause the first and second load sections to pivot about the respective first and second load pivot joints in a direction towards the flexible user support platform, wherein under the load on the flexible user support platform, the respective first and second load members pivot to press the corresponding first and second side frame members against the corresponding first and second locking pivot members, thereby biasing the first collapsible connecting frame to keep the first and second side frame members to be spaced apart to maintain the first collapsible connecting frame in the extended configuration.

2. The foldable support base as in claim 1, wherein the supplemental support frame comprises a plurality of frame members pivotally coupled to the first collapsible connecting frame.

3. The foldable support base as in claim 2, wherein the first collapsible connecting frame comprises a first scissor hinge structure pivotally interconnecting between the proximate end of the first load member and a bottom portion of the first side frame member at the first side, and the proximate end of the second load member and a bottom portion of the second side frame member at the second side.

4. The foldable support base as in claim 3, wherein the first scissor hinge structure comprises a single scissor hinge.

5. The foldable support base as in claim 4, wherein the first scissor hinge structure comprises a first connecting member and a second connecting member, wherein the first and second connecting members are pivotally connected to each other at a substantially pivotal center of the first scissor hinge structure, wherein a first end of the first connecting member is pivotally connected to the proximate end of the first load member, and a second end of the first connecting member is pivotally connected to the lower portion of the second side frame member, and wherein a first end of the second connecting member is pivotally connected to the proximate end of the second load member, and a second end pivotally connected to the lower portion of the first side frame member.

6. The foldable support base as in claim 5, wherein the first ends of the first and second connecting members of the first scissor structure are pivotally connected respectively to the proximate ends of the first and second load members by the locking pivot members structured to snap tightly to latch onto the corresponding frame member, wherein in the extended configuration under the load on the flexible user support platform, the respective load members pivot to press the corresponding locking pivot member against the corresponding side frame member to lock against the corresponding side frame member.

7. The foldable support base as in claim 6, wherein each locking pivot member is configured to snap tightly to latch onto both the corresponding side frame member and the corresponding load member.

8. The foldable support base as in claim 7, wherein pressing down on the load sections of the respective load members, the load sections of the respective load members are pivoted in a direction away from the center of the support base, thus leveraging to release against the latch created by the locking member to collapse the support base into the collapsed configuration.

9. The foldable support base as in claim 1, wherein bottom ends of the first scissor hinge structure correspond to feet of the support base for resting on an external support surface, such as a ground.

10. A foldable support base for a foldable furniture with a flexible user support platform, comprising:

at least a first support frame, which comprises:

a first load member;

a first side frame member pivotally connected to the first load member, wherein a top portion of the first side frame member is pivotally connected to a first load pivot joint along the first load member, and wherein a first load section of the first load member extends beyond the first load pivot joint, which is pivotable about the first load pivot joint towards a center of the first support frame;

a second load member;

a second side frame member pivotally connected to the second load member, wherein a top portion of the second side frame member is pivotally connected to a second load pivot joint along the second load member, and wherein a second load section of the second load member extends beyond the second load pivot joint, which is pivotable about the second load pivot joint towards a center of the first support frame;

a first collapsible connecting frame pivotally connected at a first side to a proximate end of the first load member and the first side frame member, and pivotally connected at a second side to a proximate end of the second load member and the second side frame member, wherein a first end portion of the first collapsible connecting frame has a first locking member and a second end portion of the collapsible connecting frame has a second locking member, wherein the first load member is pivotally connected to a first location along the first end portion at a distance from the first locking member, and the second load member is pivotally connected to a second location along the second end portion at a distance from the second locking member, and wherein the first collapsible connecting frame can be configured between an extended configuration in which the first and second side frame members are spread to spaced apart from each other and a collapsed configuration in which the first side frame member is brought close to the second side frame member; and a supplemental support frame coupled to the first support frame to complete the foldable support base, wherein the first and second load sections of the first and second load members are configured for removably attaching a flexible user support platform therebetween, and wherein a load on the flexible user support platform results in a force component pulling on the load sections of the first and second load members to cause the first and second load sections to pivot about the respective first and second load pivot joints in a direction towards the flexible user support platform, wherein under the load on the flexible user support platform, the respective first and second load members pivot with respect to the corresponding first and second end portions of the first collapsible connecting frame to press the corresponding first and second locking members against the corresponding first and second load members, thereby biasing the first collapsible connecting frame to keep the first and second side frame members to be spaced apart to maintain the first collapsible connecting frame in the extended configuration.

11. The foldable support base as in claim 10, wherein in the extended configuration under the load on the flexible user support platform, the first and second load members pivot to press a side of the corresponding first and second load members against the corresponding first and second locking members, whereby a section of the respective first and second load members overlap the corresponding first and second end portions of the first collapsible connecting frame.

12. The foldable support base as in claim 11, wherein pressing down on the load sections of the respective load members, the load sections of the respective load members are pivoted in a direction away from the center of the support base, thus leveraging to release the first and second load members against the corresponding first and second locking members to collapse the support base into the collapsed configuration.

* * * * *